US006763956B2

(12) United States Patent
Woods

(10) Patent No.: US 6,763,956 B2
(45) Date of Patent: Jul. 20, 2004

(54) WINE RACK AND KIT AND METHOD FOR ITS ONSITE ASSEMBLY

(76) Inventor: Daniel Woods, 1341A Dayton St., Salinas, CA (US) 93901

( * ) Notice: Subject to any disclaimer, the term of this patent is extended or adjusted under 35 U.S.C. 154(b) by 49 days.

(21) Appl. No.: 10/266,733

(22) Filed: Oct. 9, 2002

(65) Prior Publication Data

US 2004/0069730 A1 Apr. 15, 2004

(51) Int. Cl.[7] ..... A47F 7/00

(52) U.S. Cl. ..... 211/74; 211/87.01; D6/462; D7/701

(58) Field of Search ..... 211/74, 87.01, 211/105.1; D6/462; D7/701, 704; 248/251

(56) References Cited

U.S. PATENT DOCUMENTS

| | | | |
|---|---|---|---|
| 263,116 | A | 8/1882 | Close |
| 583,727 | A | 6/1897 | Braun |
| 776,332 | A | 11/1904 | Kloeppinger |
| 829,476 | A | 8/1906 | Jaquith |
| 1,022,971 | A | 4/1912 | Roberts |
| 1,511,606 | A | 10/1924 | Hamann |
| 1,559,647 | A | 11/1925 | Roth |
| D128,293 | S | 7/1941 | Carlson |
| D131,007 | S | 1/1942 | Carlson |
| 2,879,900 | A | 3/1959 | Fox |
| 2,957,585 | A | 10/1960 | Bertener |
| 3,181,701 | A | 5/1965 | Cole |
| 3,204,867 | A | 9/1965 | Wahlbom |
| 3,255,987 | A | 6/1966 | Gatch |
| 3,924,750 | A | 12/1975 | Dunchock |
| 4,022,327 | A | 5/1977 | Anderson |
| D251,049 | S | 2/1979 | Gardner |
| D262,334 | S | 12/1981 | Clarke, Jr. et al. |
| D272,699 | S | 2/1984 | Godfrey |
| 4,482,065 | A | 11/1984 | Altemose |
| 4,485,929 | A | 12/1984 | Betts, Sr. |
| D297,192 | S | 8/1988 | Mixon et al. |

(List continued on next page.)

*Primary Examiner*—Robert W. Gibson, Jr.
(74) *Attorney, Agent, or Firm*—Millen, White, Zelano & Branigan, P.C.

(57) ABSTRACT

Disclosed is a wine rack, large versions of which are adapted to be installed against a wall of a room or as a free standing wall separated from the walls of a room, which is a monolithic flat rigid sheet to which has uniformly mounted in rows through holes therein a like number of wine bottle support rods which project perpendicularly and parallel to each other from one or both faces of the sheet so that two wine bottles of varying sidewall diameter can be stored on three of the rods without their side-walls touching and whose essential elements can be fabricated offsite by forming uniform rows of holes in a monolithic sheet of stainless steel; fitting in the holes machine bolts whose threaded shank ends project beyond a face of the steel sheet; bonding the heads of the bolts to the opposite face of the steel sheet so that their threaded ends project axially perpendicularly, rigidly and parallel to each other; and forming a female threaded cavity in one end of a plurality of wine bottle support rods. The thus-fabricated structural parts of the wine rack are then transported to the installation site, where the rods are coupled to the projecting ends of the bolts. A plurality of the thus-fabricated wine rack are mounted side-by-side vertically on a wall of a room at the installation site or one of them can be installed as free standing version which is stabilizing from bending or swaying at its base. A free standing version with wine bottle support rods projecting from both faces thereof can similarly be produced using short lengths of threaded steel rods which, when inserted in the holes in the steel sheet, its ends project a short distance beyond each face of the steel sheet so that the internally female threaded ends wine bottle support rods can be mounted on both ends thereof.

26 Claims, 4 Drawing Sheets

U.S. PATENT DOCUMENTS

D307,220 S 4/1990 Kaufman, Jr.
5,145,074 A * 9/1992 Miley ..... 211/87.01 X
5,163,567 A 11/1992 Betts, Sr.
D367,592 S 3/1996 Newport
5,538,145 A 7/1996 Held
5,711,436 A 1/1998 Moeller et al.
5,813,549 A * 9/1998 Sheehan et al. ..... 211/87.01
5,813,550 A * 9/1998 Sheehan et al. ..... 211/87.01
6,361,129 B1 3/2002 Boergen
6,386,379 B1 5/2002 Battaglia
6,443,316 B1 * 9/2002 Mao ..... 211/74

* cited by examiner

WINE RACK AND KIT AND METHOD FOR ITS ONSITE ASSEMBLY

FIELD OF THE INVENTION

This invention relates to a novel wine rack, to installations comprising it, to a kit containing the elements thereof adapted for onsite assembly thereof and to a method for the fabrication of its essential elements offsite and the onsite assembly thereof.

BACKGROUND OF THE INVENTION

A wine cabinet which employs a plurality of rods mounted thereon perpendicularly at one end thereof and parallel to each other in a plurality of rows on a face of a vertical flat support member, at intervals such that x+1 adjacent rods in the same row will support x number of wine bottles, is known in the prior art. See U.S. Pat. No. 6,361,129. A wine rack in which the body of the wine bottles is supported by a pair of support pegs and the neck thereof is positioned in a hole in an upright panel is disclosed in U.S. Pat. No. 4,382,065. A wine rack which is large enough to cover most or all of the surface of a wall of a room and adapted to be mounted vertically on or against the wall, which consists essentially of a rigid flat support member which has a plurality of rods projecting perpendicularly in parallel rows from a face thereof at uniformly spaced intervals and on which wine bottles stored thereon are supported solely by two adjacent rods in the same row, with each of the two rods, except the rod at each end of a row, also providing support for an adjacent wine bottle stored in the same row without their side touching, is novel.

An open faced wine rack which is aesthetically pleasing when empty, partially filled or completely filled with wine bottles and which can be assembled onsite by unskilled labor from offsite fabricated elements without special tools and without creating quality control problems is novel. The prior art approach generally is a cabinet with doors, usually with locks, when a relatively few number of wine bottles are to be stored, e.g., in the order of a hundred or less. The cost per bottle capacity of such cabinets makes storage of a large number of wine bottles, e.g., in the order of several hundred or thousand, is very high. Thus, when a large number of bottles are to be stored, on site fabricated wood shelving on which the wine bottles rest and which maintain the bottles in a stable position and configuration is the conventional approach. The former are limited in the amount of bottles which can be stored therein and the latter, although functionally adequate, are intended for a storage area such as a wine cellar and are not designed to be aesthetically pleasing. The prior art also lacks a method of fabricating offsite and assembled onsite a wine rack whose size presents transportation and/or installation issues when it is both fabricated and assembled offsite and labor costs and quality control when it is both fabricated and assembled onsite. There also is lacking in the prior art a kit containing the structural elements of a wine rack which can be fabricated accurately, economically and rapidly offsite, which can easily be transported to an installation site and which can be accurately, economically and rapidly assembled onsite into a wine rack and installed thereat by unskilled labor without onsite fabrication of a structural element thereof

OBJECTS OF THE INVENTION

It is an object of this invention to provide a wine rack on which a plurality of wine bottles of a standard volume which have slightly varying diameters can be compactly stored without their sidewalls touching. It is another object to provide a wine rack which is aesthetically pleasing, both when empty and when partially or completely filled with bottles stored thereon. It is another object to provide the structural elements of a wine rack which can be readily, economically and expeditiously fabricated offsite and which can be assembled inexpensively and rapidly onsite and, in its preferred embodiments manually without tools by unskilled individuals. It is a further object to provide a conveniently transportable kit comprising the unassembled but completely fabricated structural elements of a wine rack which can rapidly, accurately and economically be assembled onsite. Another object is to provide an economical method-of rapidly and economically fabricating offsite the critical structural elements of a wine rack. Other objects will be apparent to those skilled in the art to which this invention pertains.

SUMMARY OF THE INVENTION

In a first article of manufacture aspect, this invention relates to an open faced wine rack for storing horizontally thereon a plurality of wine bottles of the same or substantially the same sidewall diameters, which wine rack has, as its structural elements, (a) as the sole vertical support collectively for wine bottles stored on the wine rack, a planar rigid monolithic quadrilateral vertical support member which has parallel first and second faces; and which has mounted against at least the first face thereof, (b) as the sole horizontal support individually for wine bottles stored on the wine rack, a plurality of identical straight rigid round metal wine bottle support rods, a first end of each of which is threaded and has a face which is perpendicular to the longitudinal axis of the wine bottle support rods and each is cantilever-mounted at its first end on the support member equidistantly from and parallel to each other, flush and flat against the first face of the support member, in equidistantly positioned rows, each of which contain at least three of the support rods;

(c) as first mounting means for the support rods, a plurality of identical round holes in the support member whose diameter is less than that of the support rods and the center of each of which is coaxial with the longitudinal axis of one of the support rods over which each hole one of the support rods is mounted;

(d) as second mounting means for the support rods, a plurality of straight identical round metal solid mounting rods whose diameter is slightly less than the diameter of the round holes, whose length is at least the sum of twice its diameter plus the thickness of the support member, wherein one each thereof is slip fitted and positioned in one of the round holes with a first threaded end thereof projecting beyond the first face of the support member, wherein a second end of each thereof is rigidly connected to an enlarged member which (i) has a flat under face which is perpendicular to the longitudinal axis of the mounting rod; (ii) acts as a stop which prevents the second end of the mounting rod from entering the round hole; (iii) is pressed flush against the second face of the support member so tightly that the mounting rod cannot rotate within the hole in which it is positioned; and (iv) maintains the longitudinal axis of the mounting rod perpendicular to the first face of the support member; and wherein at least the portion of the first end of each of the mounting rods which projects beyond the first face of the support member is threaded cooperatively with respect to the threaded end portion of the metal rods and is tightly screwed connected thereto, whereby the enlarged member at the second end of the mounting rods and the threaded first end of the support rods cooperatively maintain the support rods firmly and immovably mounted against the first face of the support member, and (e) optionally, a plurality of installation holes in the support member for installing the support member in a stable vertical position; and wherein (i) the support rods are long enough and three of which when mounted on the support member side-by-side in the same row are strong enough to stabily support two filled wine bottles having the same or substantially the same sidewall diameter;

(ii) each row of the support rods is uniformly spaced from adjacent rows thereof at a distance such that wine bottles of a size for which the wine rack is designed which have the narrowest sidewall diameters can be stored above those which have the widest sidewall diameters on adjacent rows of the support rods without their side walls touching;

(iii) the support rods in the same row are spaced uniformly from each other at a distance such that wine bottles of a size for which the wine rack is designed which have the widest sidewall diameter can be stored side-by-side in the same row without their sidewalls touching; and (iv) the diameter of the support rods is large enough that a wine bottle of a size for which the wine rack is designed which has the narrowest sidewall diameter can be supported by two wine bottle support rods which are side-by-side in the same row.

In a second article of manufacture aspect, this invention relates to a kit of fabricated structural elements of a wine rack of this invention which are adapted for onsite assembly thereof to form of an open faced wine rack for storing horizontally thereon a plurality of wine bottles of the same or substantially the same sidewall diameters, which structural elements comprise:

(a) as the sole vertical support collectively for wine bottles stored on the assembled wine rack, a planar rigid monolithic quadrilateral vertical support member which has parallel first and second faces and a plurality of identical round mounting holes therein which are spaced uniformly from each other in a plurality of uniformly spaced rows each of which contain at least three of the mounting holes;

(b) as the sole horizontal support individually for wine bottles stored on the assembled wine rack, a plurality at least as great as the number of mounting holes in the vertical support member of identical straight rigid round wine bottle support rods whose diameter is greater than that of the mounting holes in the support member, one end of which is threaded, whose length is at least about the length of the sidewall of wine bottles for which the wine rack is adapted to store thereon, and whose bending and breaking strengths are sufficient for three thereof which are mounted side-by-side in the same row on the support member will support two of the filled wine bottles;

(c) a plurality at least as large as the number of mounting holes in the support member of straight round solid metal or high strength plastic mounting rods whose diameter is slightly less than the diameter of the holes in the support member, whose length is at least twice the sum of its diameter plus the thickness of the support member, each of which is adapted to be slip fit positioned in one of the round holes, a first end of each of which is threaded so as to be threadably joined to the threaded end of a support rod and which extends beyond the first face of the support member, a second end of each of which is or is adapted to be connected to an enlarged member which (i) has a flat under face; (ii) acts as a stop which prevents the second end of the mounting rod when fitted in one of the mounting holes in the support member from entering the mounting hole; (iii) is fitted flush or is adapted to be fitted flush against the second face of the support member so tightly when the wine rack is assembled that the mounting rod cannot rotate within the mounting hole in which it is positioned; and, when thus fitted, (iv) maintains the longitudinal axis of the mounting rod perpendicular to both faces of the support member; and wherein at least the portion of the second end of each of the mounting rod which projects beyond the first face of the support member is threaded cooperatively with respect to the threaded end portion of the support rods and is adapted to be threaded connected thereto, whereby the enlarged member of the mounting rod and the threaded second end of the mounting rod cooperatively maintain, when the wine rack is assembled, the support rods firmly and immovably mounted against the first face of the support member, and (d) optionally, a plurality of installation holes in the support member, at least a portion of which are proximate an upper or lower edge of the support member, for installing the support member in a stable vertical position; and wherein (i) the support rods are long enough and three thereof side-by-side in the same row of the assembled wine rack are strong enough when mounted on the support member to stabily support two filled wine bottles having the same or substantially the same sidewall diameter;

(ii) each row of mounting holes in the support member is uniformly spaced from adjacent rows of holes at a distance such that wine bottles of a size for which the wine rack is designed which have the widest sidewall diameter can be stored one above the other on adjacent rows of the assembled wine rack without their side walls touching;

(iii) each mounting hole in the support member is spaced uniformly from mounting holes on either side thereof in the same row at a distance such that wine bottles of a size for which the wine rack is designed which have widest sidewall diameter can be stored side-by-side in the same row of the assembled wine rack without their sidewalls touching; and (iv) the diameter of the wine bottle support rods is large enough that a wine bottle of a size for which the wine rack is designed which has the narrowest sidewall diameter can be supported by two adjacent wine bottle support rods in the same row of the assembled wine rack.

In a third article of manufacture, this invention relates to a combination of a plurality of wine racks of this invention, preferably ones fabricated and assembled according to the method of this invention, and a sidewall of a room onto which the wine racks are stabily mounted edge to edge vertically thereon against the interior face of the sidewall.

In a method aspect, this invention relates to a method of producing onsite a wall size wine rack of this invention adapted to be mounted on an interior face of a wall of a room or on the floor of a room, which comprises the offsite fabricating steps of:

(a) forming, in a planar rigid monolithic quadrilateral support member large enough and strong enough to be the vertical support member of a wine rack of this invention, a plurality of at least three identical round mounting holes in a plurality of rows, each of which rows is spaced apart from adjacent rows thereof at a distance such that the sidewalls of bottles which are stored in one row of the fabricated wine rack do not touch the sidewalls of bottles stored in a row adjacent thereto and each mounting hole is spaced uniformly from other mounting holes in the same row at a distance such that a wine bottle stored on the assembled bottle rack which has the narrowest width will be supported by two adjacent wine bottle support members, and optionally also forming in the support member a plurality of installation holes, at least a portion of which are proximate an upper or lower edge of the support member, for installing the support member in a stable vertical position;

(b) forming a female threaded cavity in one end of a plurality at least as great as the number of mounting holes in the support member, of identical straight rigid round metal or plastic rods suitable for use as support rods for wine bottles in the assembled wine rack whose diameter is greater than that of the mounting holes in the support member and whose length is at least about the length of the side wall of wine bottles for which the wine rack is adapted to store thereon; which comprises the subsequent assembling steps, either offsite or onsite, of (c) inserting in each mounting hole a straight round solid mounting rod which (i) is male threaded at least at a first end thereof so as to be threadably connectable to the female threaded end of one of the support rods, (ii) has a diameter which is slightly less than the diameter of the mounting hole so that it can be slip fitted into and through one of the mounting holes, (ii) has a length which is at least the sum of twice its diameter plus the thickness of the support member so that a threaded end thereof projects beyond the first face of the support member, (iii) has rigidly connected to the second end thereof an enlarged member which is larger than the mounting hole, which has a flat under face which is perpendicular to the longitudinal axis of the mounting rod and which acts as a stop which prevents the second end of a mounting rod which is inserted in a mounting hole from entering the mounting hole, so that the under face of the enlarged member is flush against the second face of the support member;

(d) bonding to the vertical support member the enlarged end of each mounting rod which is thus inserted in a mounting hole thereof; which comprises the step of (e) transporting the thus fabricated support member and plurality of rods to the installation site for the wine rack; and which comprises the subsequent onsite steps of:

(f) stabily mounting the thus produced wine rack in a vertical configuration at the installation site, either against a wall of a room or free standing at a distance therefrom and mounted on the floor of the room; and, (g) rigidly coupling the fabricated end of one of the lengths of the thus-fabricated rigid rod-shaped material to the free end of each of the thus mounting rods so that the fabricated end of each support rod which is thus coupled to the projecting end of a mounting rod is flush with and projects outwardly perpendicularly from the first face of the support member, parallel to the other thus mounted support rods; and (h) optionally, when the wine rack is installed at a distance from a side wall of the room, stabilizing the support member at its base against swaying or bending.

BRIEF DESCRIPTION OF THE DRAWINGS

Various features and attendant advantages of the present invention will be more fully appreciated as the same becomes better understood when considered in conjunction with the accompanying drawings, in which like reference characters designate the same or similar parts throughout the several views, and wherein.

DETAILED DISCLOSURE

Figure 1:
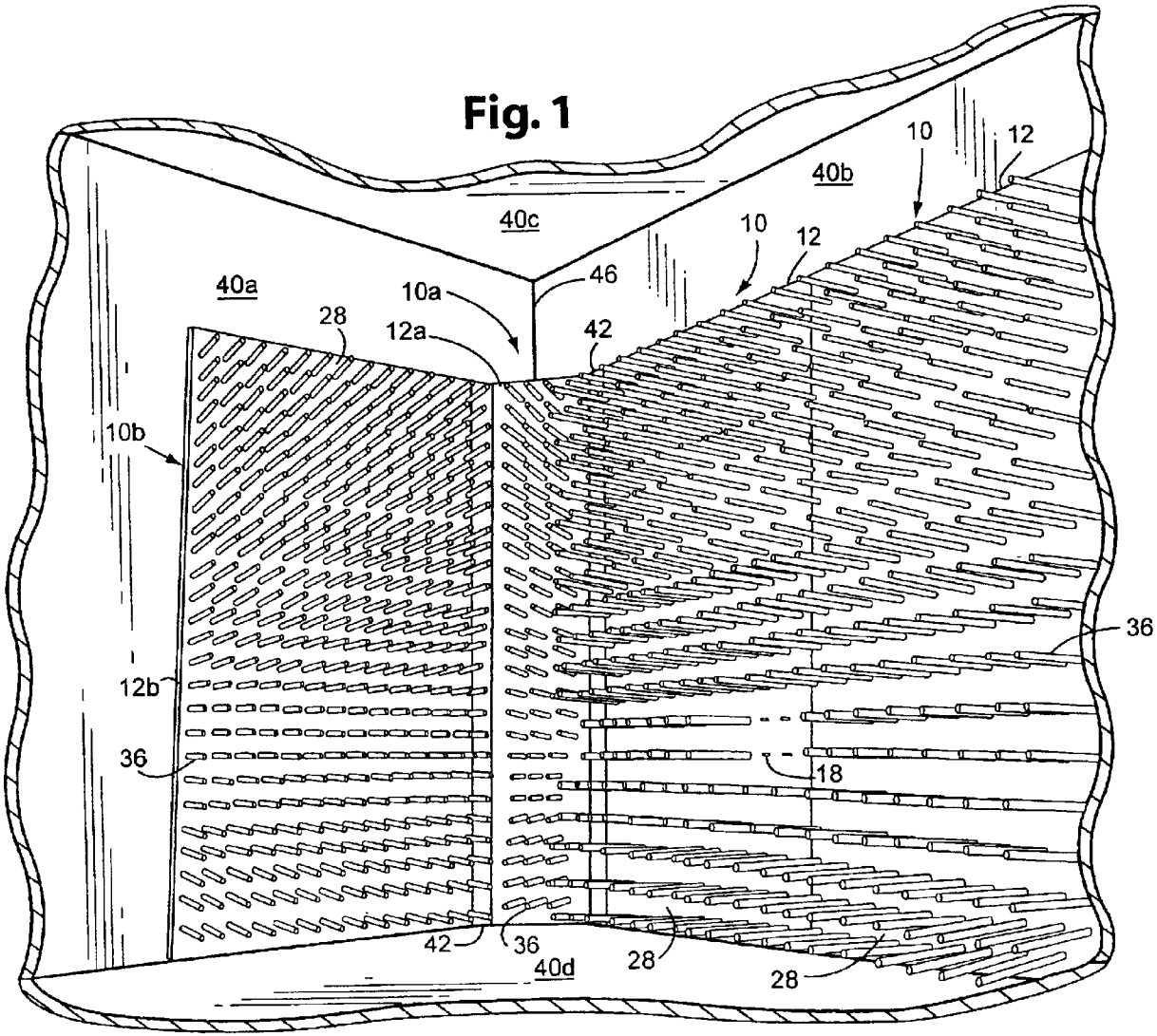
FIG. 1 is perspective and fragmentary view of a portion of two walls at a corner of a room, onto one of which a pair of wine racks of this invention are mounted, onto the other of which is mounted another of the wine racks of this invention and the corner of the room where the two walls meet at which a third wine rack of this invention is installed.

As used herein, the term "open faced" means the wine rack lacks doors and associated structural sidewalls; "vertical" and "vertically" means when the wine rack is in its installed configuration; "perpendicular" and "perpendicularly" mean projecting at a right angle from a face of the support member when the wine rack is assembled; "varying but substantially the same sidewall diameters" means a variation insufficient for the sidewalls of two wine bottles having the largest sidewall diameter for which the wine rack is designed to store which are stored on the wine rack to touch when stored side by side or for a wine bottle having the smallest such sidewall diameter to touch when stored directly above a wine bottle having the largest such sidewall diameter or for a wine bottle with the smallest sidewall diameter from slipping between two side by side support rods, e.g., up to about ±15%, from the average such diameters; "planar" means flat without indented or protruding areas; "rigid," when used in connection with the vertical support member, means that neither it nor an area of the face thereof surrounding a support rod mounted thereon flexes or bends when the wine rack is fully loaded with filled wine bottles and similarly means that a wine bottle support rod neither flexes or bends under the weight of a full wine bottle stored thereon; "quadrilateral" embraces both the preferred rectangular and square shapes as well as the corresponding shapes in which one or more of the corners thereof are not right angular and/or one or more of the edges thereof are not linear, either for aesthetic reasons or to conform the support member to an edge of a wall of a room on which the wine rack is mounted; "monolithic" means either the support member is formed from a single piece of the material or its exposed face or faces has the visual appearance, by sheathing or a coating thereon, of being formed from a single piece; "mounting rod" embraces both a separate member and an extension on a support rod which can be inserted so that an end portion thereof extends beyond the opposite face of the support member; "slip fit" means the mounting rod can be inserted manually in a mounting hole in the support member but retains the shaft of the mounting rod perpendicular to the faces of the support member; "plurality of identical rods" means at least about 25, preferably at least 50, e.g., from 100 to 500 or more; "plurality of rows" means at least about 6 and, in the case of a wine rack mounted or adapted to be mounted flush against the wall of a room or free standing and spaced apart from a wall and hung from the ceiling or mounted on the floor of a room, at least about 10 rows, e.g., from ten to twenty or more rows; and "free standing" means spaced apart from the walls of a room, typically far enough to create a walkway therebetween, e.g., at least about 30 inches.

DESCRIPTION OF THE PREFERRED EMBODIMENTS

In its preferred aspects, the article of manufacture aspects of this invention embody one or more (to the extent they are compatible with each other) of the following a. The wine bottle support rods are solid, for maximum bending and breaking strengths; however, when they are metal they can be hollow, provided their resistance to denting and bending during normal use of the wine rack is adequate and preferably also provided their free end is capped so as to give a visual appearance of being solid.

b. The support rods each are mounted perpendicularly sufficiently uniformly to appear visually identically to the exposed face of the support member onto which they are mounted and are parallel to each other. Although theoretically the rods can project slightly upwardly relative to the face of the support member in order to increase the stability of wine bottles stored thereon and reduce the risk of bottles sliding off the rods as a result of vibration due machinery or earthquake, it is preferable if this is an actual or perceived risk to either slide an elastic ring gasket on the free end of the support rods or slant the support member in its installed configuration slightly from exactly vertical to achieve the desired upward tilt of the support rods mounted thereon rather than slant the rods relative to the face of the support member because of the increased difficulty associated with the latter option of mounting and maintaining all of the support rods parallel to each other.

c. The support rods are round; although other shapes, e.g., oval, square, triangular or hexagonal, are theoretically possible but not preferred because of the assembly problem created of ensuring that they are both rigidly mounted and identically configured in their transverse configuration, not only for appearance sake but more importantly because otherwise the effective distance between them with respect to the height upon which any specific bottle would rest would vary and as a result the functional aspect of the invention of storing bottles of slightly varying sidewall dimensions without their sidewalls touching would be jeopardized and also the number of bottles that could be stored on the wine rack would be reduced.

d. The diameter of the wine bottle support rods is about one inch, e.g., ⅞ to 1¼ inch, the optimum diameter depending in part on the amount of variation in sidewall diameters of the wine bottles stored thereon and their length depends on the size of the bottles which are to be stored on the wine rack, i.e., they generally are about the height of the side wall of the wine bottles stored thereon viz., from about 7½ to 8½ inches for 375 and 750 ml. bottles and about 8 to 11 inches for 1.5 liter bottles. When support rods with a configuration other than the preferred round rods are used, the distance between their side wall surfaces at the point at which they contact with the side walls of wine bottles stored thereon, and the longitudinal axis of the rod should be the same as the radius of a corresponding round rod which would position the same wine bottles so that their sidewalls would not contact the sidewalls of wine bottles stored in rows above or below them.

e. The mounting means by which the support rods are mounted against a face of the support member is preferably the combination of a female threaded cavity at one end of the support rod and a male threaded mounting rod which is slip fit inserted in a mounting hole in the support member, with an end portion thereof projecting from each face thereof, one end of which is adapted to be screwed tightly into the female threaded cavity of a support rod and the other is bonded to the other face to prevent the mounting rod from rotating in the mounting hole.

Alternatively, the male threaded mounting rod can be threaded offsite or onsite into the female threaded cavity of a support rod until the inserted end thereof is pressed against the bottom of the cavity with the other end portion thereof projecting beyond the end of the support rod or the male threaded mounting rod can be a male threaded end portion of a support rod which lacks a female threaded cavity, which male threaded end portion is adapted to be inserted in a mounting hole in the support member and is long enough to project beyond the opposite face thereof and then screwed tightly into a female threaded cavity of another support rod positioned on the other side of the support member until the pair of support members are drawn tightly against respective faces of the support member. In either case, the mounting means preferably is not visible on the face of the support member when a support rod is mounted thereon.

f. The support member and wine bottle support rods are metal, preferably the same metal and most preferably stainless steel, although other metals and materials, such as titanium, bronze, aluminum, chrome, silver or gold plated steel, tempered glass, polyacrylate, polycarbonate and other high strength rigid clear or fiber filled plastic. The support member can also be a metal faced composite product, e.g., stainless steel-, aluminum-, bronze-, or copper-clad hardwood, softwood, plywood, high density fiberboard or particle board, provided its metal face upon which the support rods are mounted is rigid enough to resist bending and denting, maintain the support member in a planar vertical configuration; to maintain the support rods in their parallel horizontal configuration under a full load of filled wine bottles; and to resist deformation or breakage due to an accidental blow to an area thereof during normal usage.

Their exposed surfaces preferably have at least a machine finish, e.g., No. 4 satin, but other surface finishes, e.g., matte, semi-gloss, enamel or mirror finish lacquered or enameled coated or powder particle coated or chrome or precious metal plated base metal, can be employed, depending on the desired decorative appearance and its resistance to wear.

g. The support member is either rectangular or square, primarily for economies of fabrication and installation reasons, although other quadrilateral shapes adapted for custom installations are possible, e.g., when the floor of a room is not flat or exactly perpendicular to a side wall on which the wine rack is installed.

h. The support member is at least about two feet wide and at least about four feet long, and for simplicity of installation when installed on a wall of or on the floor of a wine cellar, preferably at least 3 feet wide and at least 6 feet long, most preferably 3'×8', 4'×8' or 5'×8', because these specific sizes are readily available commercially, but they can be as large as a wall of a room, e.g., up to about 12 ft. long and/or up to about 10' wide. However, weight and ease of installation becomes size limiting factors with respect to larger support members, particularly when the support member is formed of a solid piece of heavy metal, e.g., stainless steel or titanium. Smaller dimensions are preferable for portable versions of the wine rack of this invention. A monolithic effect can be achieved fitting together a plurality of smaller wine racks of this invention closely edge to edge and, optionally, welded or brazing their seamed edges together in the case of metal, or bonding the edges together with high strength adhesive or tongue and groove or adhesively bonded wood pieces can be used, so that the exposed face of the resultant assembled piece has a monolithic visual appearance, i.e., any seam(s) is not visible, as a result of sanding, grinding or sheathing, or visually is not readily apparent because the abutting edges of the pieces are fitted so tightly together.

i. The support member has a plurality of mounting means, corresponding in number to the rods mounted on the face thereof, which project perpendicularly outwardly therefrom coaxially with and parallel to the rods to which they are rigidly connected when the wine rack is assembled, which mounting means preferably project through a corresponding number of coaxially positioned mounting holes in the support member, e.g., the mounting means is the threaded shaft of a bolt whose head is bonded adhesively or, in the case of a metal support member, welded, brazed, soldered or laser fused to the second (back) face of the support member and whose free end is connected coaxially to a rod by a female threaded aperture in one end of the rod. In the case of stainless steel.

j. The wine rack is mounted on a wall of a room and a plurality thereof cover horizontally a majority or all of the exposed surface of the wall; and/or a plurality of the wine racks are mounted on two walls of a room and cover horizontally all or a majority of the interior surface of both walls; or a pair of the wine racks are mounted on two walls of a room which are at right angles to each other and, optionally, another of the wine racks which is narrower than the pair, e.g., 1' to 4' wide, is mounted at approximately a 45 degree angle to the exposed face of each the pair of wine racks and whose width is sufficient to prevent the free ends of the wine bottle support rods projecting therefrom from overlapping or contacting the support rods proximate the intersecting edge of either of the pair of wine racks whose vertical edges its vertical edges contact.

k. The wine rack's support member has installation means in the face thereof, e.g., holes or slots at the base of the support member adapted to rigidly fit the support member vertically free standing on a base, such as pair of legs, each of which project perpendicularly and at right angles from both faces thereof, or two or more holes proximate the upper edge of the support member into which wires can be fitted to hang the support member from the ceiling of a room with the bottom edge of the support member resting on the floor of the room in clamps mounted in the floor which prevent the support member from moving, and the wine rack is positioned in a room spaced apart from the walls thereof sufficiently to permit an adult human to walk between the wine rack and the wall of the room closest thereto.

l. A first area of the wine rack has a first group of rods whose length and the distance from which they and the rows thereof are spaced from each other is adapted to store a plurality of wine bottles of a first smaller size thereon and a second area thereof has a group of rods mounted thereon whose length and the distance from which they and the rows thereof are spaced apart from each other are adapted to store a plurality of wine bottles of a second larger size.

In addition to wine bottles, the wine rack of this invention can also be used to store glass and plastic bottles filled with other liquids, such as beer, soft drinks and water.

DETAILED DESCRIPTION OF DRAWINGS

Figure 4:
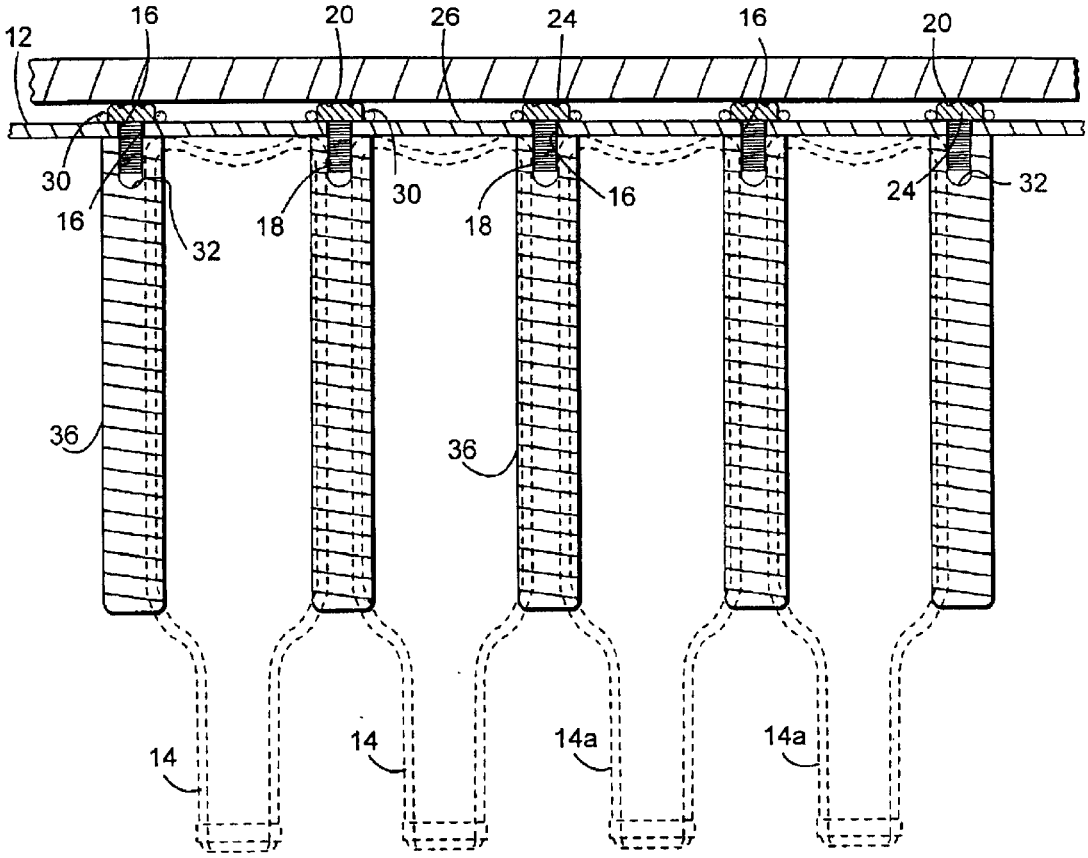
FIG. 4 is a cross-sectional side view in the plane III—III of the center of the wine bottle support rods of the upper of the two rows of wine bottle support rods of the section of the wine rack shown in FIG. 3, mounted on the vertical support member of one of the wine racks shown in FIG. 1, with the wine bottles stored on the support rods shown in ghost.

Shown in FIG. 1 are two side wall wine racks 10, 10*b* of this invention mounted respectively on two intersecting side walls 40*a* and 40*b*, the corner support member 12*a* mounted on both walls at the vertical shoulders 42, and the bottom edge of all three resting on the floor 40*d* of the room with their top edges spaced from the ceiling 40*c*. Mounted uniformly in uniformly spaced rows on and projecting from the exposed face 28 of the support members are a large number of wine bottle support rods 36 except at four points on one of the side wall support members in order to show the machine bolt threaded end 18 of machine bolts projecting from mounting holes 16 (visible in FIG. 4) in the support member 12, onto which four additional support rods 36 will be threaded to complete the assembly of that wine rack.

Figure 2:
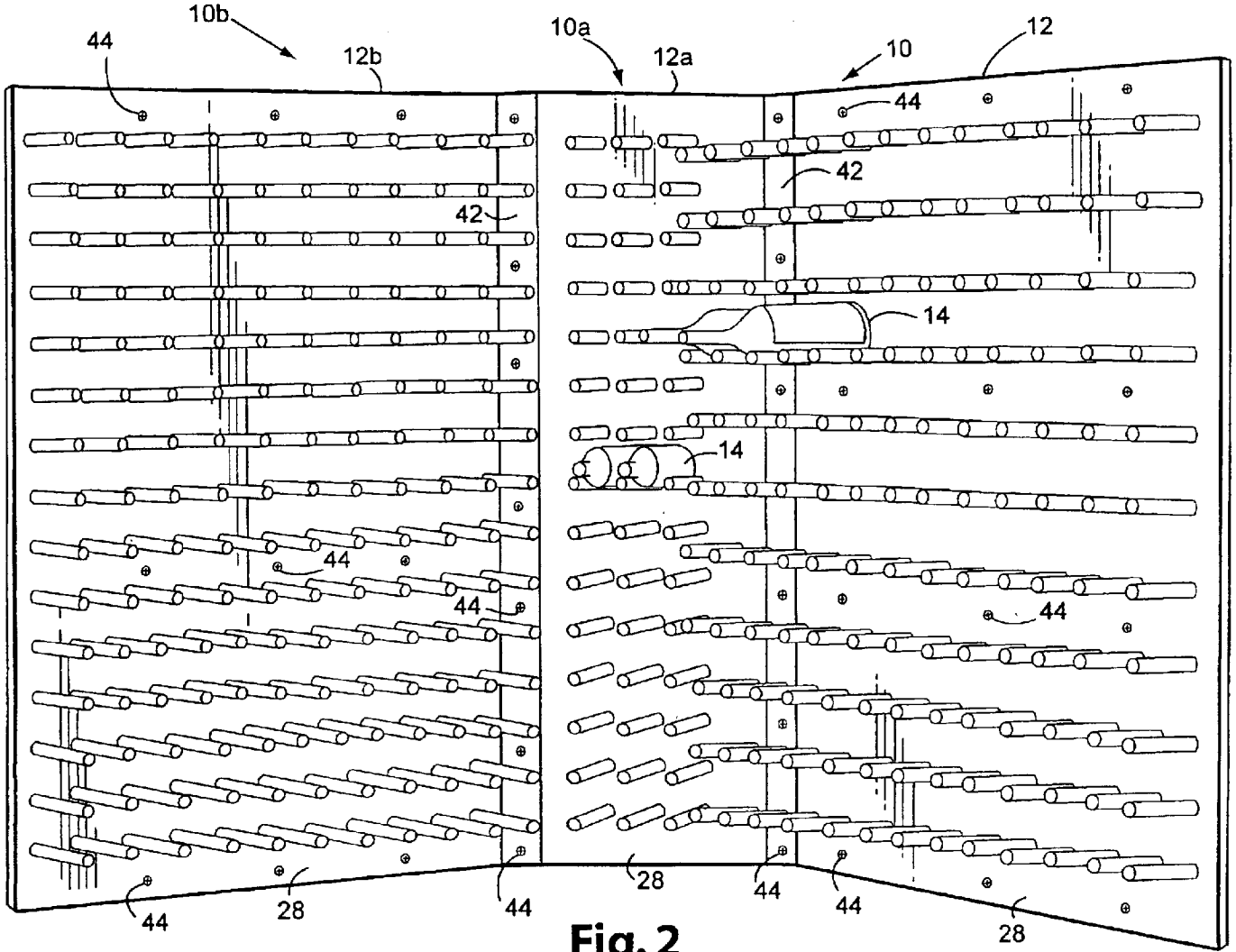
FIG. 2 is a close up perspective view of the corner mounted wine rack and two of the wall mounted wine racks shown in FIG. 1, on which two wine bottles are shown in ghost stored on the corner unit and one wine bottle is similarly shown stored on the right hand wall mounted unit and one unit of which is constructed for smaller bottles.

FIG. 2 shows a closer view of the wine racks shown in FIG. 1, one of which 10 is designed to store larger wine bottles than the other 10*b*, and for illustrative purposes, two wine bottles 14, each mounted on two of the wine bottle support rods 36 mounted on the exposed face 28 of the support member 12 of one of the side wall wine racks and two more mounted on two of the support rods on the exposed face of the support member 12*a* of the corner wine rack. Also can be seen are the two bent shoulders 42 of the corner support member 12*a*, which permit it to be installed tightly edge to edge between two side wall support members 12, and the heads of a plurality of installation screws 44 used to mount all three support members to a side wall of a room.

Figure 3:
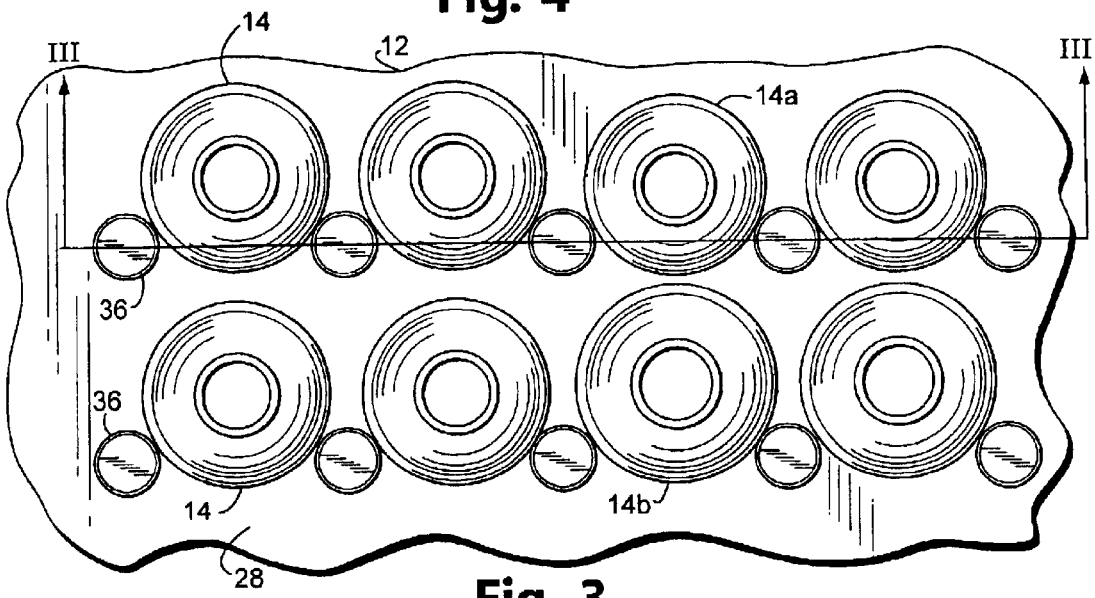
FIG. 3 is a fragmentary side view of two five-wine bottle support rod sections of two rows of wine bottle support rods mounted on the vertical support member of one of the wine racks shown in FIGS. 1 and 2, showing in ghost wine bottles of varying side diameter stored thereon.

The fragmentary side view of a two-row, five-support rod area shown in FIG. 3 of the wine racks shown in FIGS. 1 and 2 shows standard size 14, slight smaller sidewall size 14*a* and slightly larger sidewall size 14*b* wine bottles stored bottom end first on pairs of support rods 36 without their side walls touching. The corresponding fragmentary cross-sectional top view of FIG. 4 at plane III—III of FIG. 3 of a five-support rod area of a row of the support rods whose heads are shown in FIG. 3 shows the details of how the threaded end 18 of machine bolts 20 are fitted through mounting holes 16 and threaded into the support rod cavity 32 at one end of wine bottle support rods 36 so that latter are firmly pressed against the exposed face 28 of support member 12 (or 12*a*), with the undersurface machine bolt head 24 pressed firmly against the wall facing face 26 of support member 12 (or 12*a*) and held firmly positioned thereat by tack weld spots 30 and against a side wall 40*a* or 40*b* of a room in which the wine rack is installed and held thereat by installation screws 44 (not shown) whose head is shown in FIG. 2.

Figure 5:
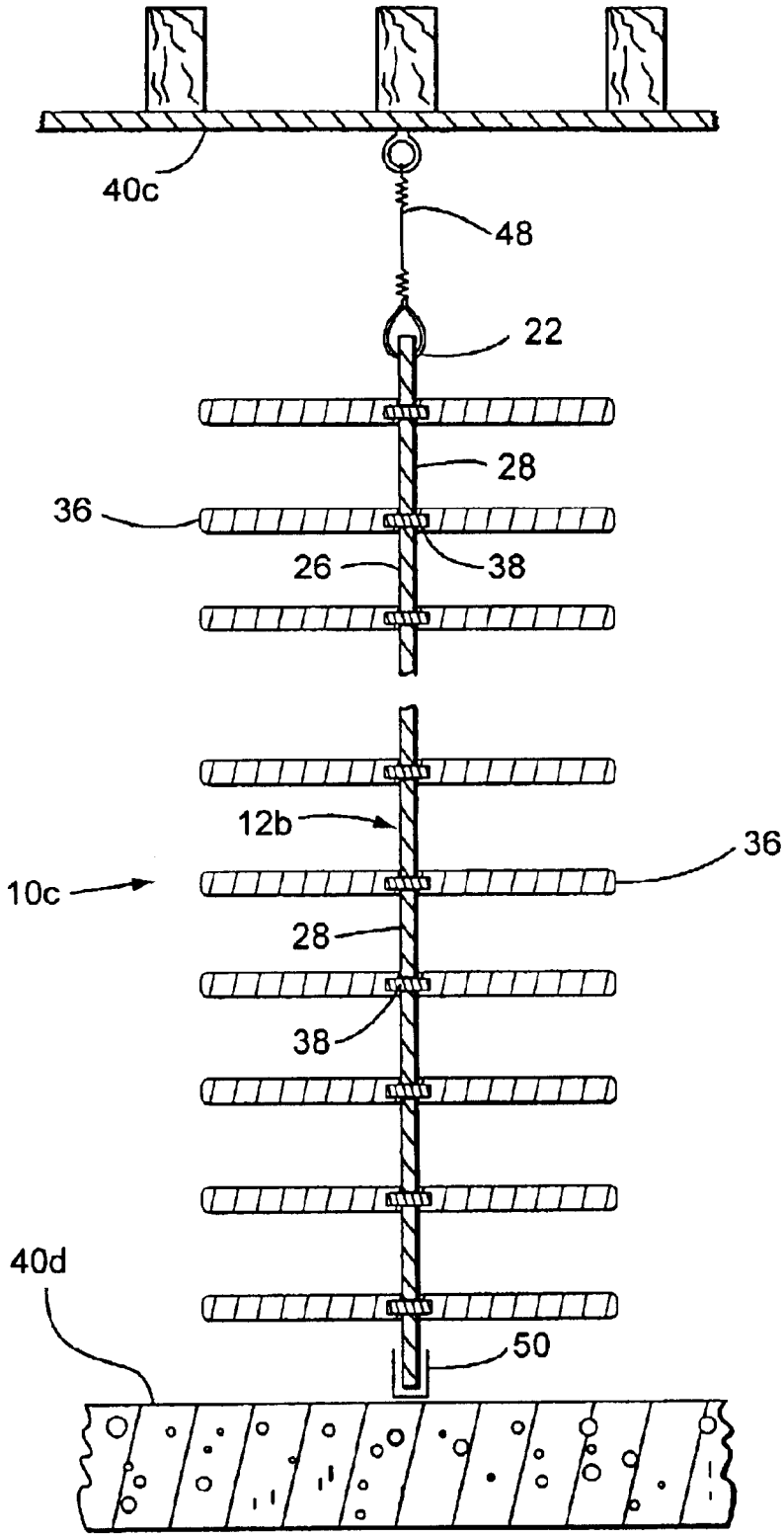
FIG. 5 is a cross sectional side view along at the plane defined by the center of a vertical row of the mounting holes and the axial center of the rod support members mounted on free ends projecting from both faces of support rod mounting members fitted in the mounting holes of a free standing wine rack of this invention.

In FIG. 5, a free standing wine rack 10*b* of this invention is shown in which a vertical support member 26 is suspended by installation screw 44 from the ceiling 40*c* of a room by a support wire 48 with its weight resting on the floor 40*d* of the room and maintained in a stable position by a pair of floor positioning U-clamps bonded to the floor into which the bottom edge of the support member 26 are tightly fitted.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

EXAMPLES

Example 1

To produce a wall mount wine rack 10 shown in FIGS. 1 and 2, e.g. at an offsite fabrication machine shop, using a computer software driven "Trumfp 360" laser torch cutting machine, programmed to cut ⅜ inch diameter holes and positioned over a 4 ft.×8 ft. rectangular machine finish (No. 4 "satin") 11 gauge (⅛ inch) standard stainless steel wall steel sheet which is to be fabricated into a vertical side wall support member 12 of a wine rack 10 adapted for storing 750 ml wine bottles 14 thereon, with the steel sheet positioned flat over a water-filled quenching reservoir, cut as wine bottle support rod mounting holes 16 in wine rack 10, ca. ⅜ inch holes 16 in the steel sheet (which will permit the threaded shank 18 of a ⅜–24 inch×½ inch SAENF stainless steel machine bolt 20 to be inserted and slip fitted therein) at 3.42 inch intervals in rows 3.419 inches apart, beginning 3.463 inches vertically and 3.490 inches horizontally from the corner thereof corresponding to the upper right corner of the support member as installed, thereby forming 11×27= 379 wine bottle support rod mounting holes 16 therein. Then, using the same equipment, cut ¼ inch installation holes at 9 to 12 inch intervals equidistant from each other and from the side edges of the sheet plate in equidistant rows between rows of mounting holes 16.

Next, insert one of the machine bolts 20 into each of the thus-produced wine bottle support rod mounting holes 16, thereby positioning the bolt coaxially in the hole with its head 24 flush against what will become the face 26 of side wall support member 12, which will face a wall of the room when side wall support member 12 is mounted thereon, with its threaded shank 18 projecting ⅝ inch beyond other face 28 of side wall support member 12 which will be exposed when the steel sheet is mounted against the wall. Tack weld head 24 of machine bolt 20 in place to face 26 of side wall support member 12 at two tack weld spots 30 which are 180° apart from each other at the edge of head 24 of each bolt 20, making certain (using heat shrink technique) that the heat generated in doing so does not shift machine bolt 20 from its perpendicular orientation relative to the faces of or discolor the opposite side thereof. Follow the same procedure with each of mounting holes 16 until each hole has a machine bolt 20 inserted therein coaxially with their head 24 bonded to the same face 26 of the stainless steel side wall support member 12 so that it cannot rotate and their threaded shank end 18 projects perpendicularly beyond the other face 28 thereof.

Using a conventional water cooled metal band saw, cut a bundle of about 20 one inch diameter machine finish (No. 4 "satin") stainless steel rods 144 inches long into 8 inch lengths. Grind one end of each rod to a machine (satin) finish and drill a hole in the other end to form a. ⅜ inch diameter wine bottle support cavity 32 therein which is about ⅝ inch deep. Next, thread tap the cavity to form SAENF female threads 34 therein, thus forming a wine bottle support rod 36 whose threaded cavity 32 can be threaded onto the threaded shank end 18 of one of the machine bolts 20 projecting from the face of the side wall support members 12.

Follow this procedure with enough additional 4 feet×8 feet stainless steel side wall support members 12 and 8 inch stainless steel rods to produce wall racks 10 to cover horizontally at least two opposite facing or intersecting walls 40*a* and 40*b* of the room. If the width of either of the two opposite facing walls is not an exact multiple of 4 feet, in order to completely cover the wall completely horizontally with wine racks, cut a 4 foot wide sheet vertically to a width which will produce a narrower support member 12*a* which will fit into the less than 4 feet wide space at one end of the wall which is formed when a plurality of standard width wine racks are mounted on that wall, side-by-side with their vertical edges touching.

If the two walls intersect, to maximize the number of wine bottles which can be stored on the wine racks at the corner 46 of the room, mount sheet support members 12 whose widths collectively leave an about one foot wide portion at the corner. In a narrower sheet of stainless steel plate, otherwise corresponding to the standard with plates used to produce the side wall mounted support members 12, of a width which will fit at an about 45 degree angle into the space to form when mounted at corner 46 a corner mounted corner support member 12*a* with its vertical edges fitted tightly against the vertical end edges of two adjacent side wall support members 12. Using the laser cutting tool described above, cut support rod mounting holes 16 corresponding to those cut in the 4 foot wide stainless steel sheets in the face thereof, except in vertical bands about 4 inches along each side thereof and in the latter cut installation holes therein. Bend the about four inch wide section along both vertical sides of the a stainless steel plate at a about a 45 degree angle toward the face of the sheet which will face the corner of the room, thereby forming a corner support member 12*a* with a vertical shoulder 42 (wing) running the entire length of each side thereof.

Transport the thus-fabricated support members 12 and corner support members 12*a* (preferably with their face which will face outwardly when the wine racks are installed protected by a heavy duty protective sheet of paper (not shown, which can be peelably removed after they are mounted on the walls), along with a number of wine bottle support rods 36, fabricated as described above, corresponding to the number of machine bolts 20 mounted on the support members (plus extras for onsite loss or damage); and optionally also a number corresponding to the number of installation holes in the support members (plus extras for onsite loss or damage), of "Tapcon" stainless steel cement screws which are packaged in appropriate cartons, as a kit by truck to the installation site.

At the installation site, successively position on two concrete walls 40*a* and 40*b* of a room thereat (a wine cellar), each of which walls are about a foot longer than the number of units of the offsite thus-fabricated 4 foot×8 foot steel sheets 12 required to cover horizontally the two walls, except for the about one foot end portion of each of the two walls at the corner where the two walls meet at the other ends of the walls, with their bottom edge as close as possible (about 3 inch) to the cement floor of the room (to compensate for irregularities in its surface) and their face 26 with the machine bolt heads 24 laser welded thereto facing the concrete walls. Install the support members 12, one at a time and side-by-side vertically, with their 8 foot vertical edges fitted tightly against each other, onto the concrete wall behind them with the "Tapcon" stainless steel cement screws, whose heads 44 can be seen in FIGS. 1 and 2, fitted through the installation holes in the support members, leaving bare the section at the end of the two walls and wall corner 46. Position the custom cut narrower corner support member 12*a* between the terminal vertical edge 43 of the two side-wall support members 12 mounted closest to wall corner 46 so that its vertical edges 43 are pressed tightly against those of the 4 feet by 8 feet support members 12 mounted thereto and install narrower corner support member 12*a* thereat with "Tapcon" stainless steel cement screws inserted in the installation holes in the same manner as the standard 4 foot by 8 foot wall mounted support members 12 or 12*a*.

Remove the protective paper covering the exposed face 28 of the installed support members 12 and 12*a*, and then thread the threaded shank end 18 of each of the machine bolt 20 projecting therefrom as tightly as possible manually (enough to bond the inserted end thereof by galling to the exterior face of the support member), into the threaded cavity end 32 of wine bottle support rods 36 thereby creating onsite a plurality of wine racks 10 and 10*a* of this invention installed on and completely covering the two side walls 40*a* and 40*b* and wall corner 46 of the room (except for the space between the tops of the wine racks and the ceiling of the room and between their bottom edges and variations in the floor of the room at its intersection with the walls upon which the wine racks were installed).

Example 2

To produce a wall mounted wine rack 10 otherwise corresponding to the wall mounted racks 10 of Example 1 but adapted for mounting 375 ml wine bottles thereon, follow the same procedure except cut the mounting holes 16 in the 4 foot×8 foot steel sheets at 2.823 inch intervals in rows 3 inches apart, beginning at 1.412 inches vertically and 2.850 inches horizontally from the upper right hand corner thereof. Adjust the margins for the installation holes cut in the custom cut corner steel sheet used to form corner support member 12*a* so that they are similarly positioned symmetrically therein.

Optionally, instead laser cut the support rod mounting holes 16 in one or more of the steel sheets used to produce side wall support members 12 and/or the custom cut steel sheet used to produce the corner support member 12*a* in the manner described in Example 1 only in a partial area of one or more of the support members and cut the rest of the mounting holes at the intervals and at a distance between the rows as described in this example. A wine rack 10 or 10*a* is thus produce on which both 750 ml and 375 ml bottles of wine can be stored.

Example 3

To produce a wall mounted wine rack 10 otherwise corresponding to the wall mounted racks of Example 1, adapted for mounting 1.5 liter wine bottles thereon, fabricate the internally threaded cavities 32 in 9 inch lengths of stainless steel mounting rods and cut the support rod mounting holes 16 in the steel sheet used to produce the side wall support members 12 at 4.364 inch intervals in rows 4.546 inches apart, beginning at 2.182 inches vertically and 3.480 inches horizontally from the upper right hand corner thereof. Adjust the margins for the holes in the custom cut corner steel sheet 42 so that the holes are symmetrically positioned therein.

In the manner described in Example 2, create the support rod mounting holes 16 in one or more of the steel sheet used to produce the side wall support members 12 in the manner described in Example 1 only in a partial area of the support member and create them at the intervals and at a distance between the rows as described in this example in the rest of the area of the support member, thereby producing a wine rack of this invention on which both 750 ml and 1.5 liter bottles of wine can be stored.

Example 4

To produce a free standing wine rack 10*b* otherwise corresponding to s wall mounted wine rack 10 of Example 1, but with wine bottle support rods 36 projecting from both faces 26 and 28 thereof, fabricate a 4 foot×8 foot stainless steel vertical support member 12 with a plurality of ⅜ inch mounting holes 16 therein, following the procedure of Example 1. Cut a ⅜–24 inch SAENF threaded stainless steel rod of any convenient length into ⅞ inch lengths for use as wine bottle support rod mounting rods 38. Form a plurality of installation holes in the support member proximate its top (when installed) edge.

Transport to the selected installation site as a kit one or more of the thus-fabricated stainless steel vertical support members 12 along with at least twice the number of mounting holes 16 therein of wine bottle support rods 36 fabricated as described in Example 1 and with a plurality at least corresponding to the number of mounting holes 16 in support member 12 of the ⅞ inch long lengths of threaded mounting rods 38 and a number of installation screws 44 at least corresponding to the number of installation holes in each support member.

At the installation site, position the support member 12 in its installed vertical free standing position either by a pair of stainless steel wires 48 threaded through or clevis stainless steel turnbuckles inserted in two installation holes along the top edge of the support member and connected to the ceiling 40*c* of the room, with the weight of the support member resting on the floor 40*d* with its bottom edge fitted in a pair of U-shaped positioning floor clamps 50 mounted on the floor 40*d* of the room. Next insert into each mounting hole 16 one of the ⅞ inch lengths of threaded stainless steel mounting rods 38 so that a threaded end portion thereof projects beyond each face of support member 12. Thread the female threaded cavity end of one of the 8 inch wine bottle support rods 36 onto both of the projecting ends of each of the mounting rods 38 positioned in mounting holes 16 in side wall support member 12 and turn both support rods until both are threaded onto the mounting rod and pressed tightly against opposite faces of the support member. Although the order in which the support rods 36 are mounted on the support member is not critical, it is preferable to mount them one row at a time beginning at the bottom of the installed support member and concurrently on both sides thereof. When a support rod 36 is mounted on the projecting ends of the mounting rods fitted in the mounting holes of support member 12, an installed wine rack 10*b* is produced.

Alternatively, a ⅞ inch threaded stainless steel mounting rod 38 is threaded offsite into the support rod cavity 32 of the number of wine bottle support rods 36 which corresponds to the number of support rod mounting holes 16 in support member 12, so that an end of each of the mounting rods 38 projects about ½ inch beyond the threaded end of each mounting rod 38. After support member 12 is installed vertically onsite at a selected free standing installation position in an onsite room, a wine bottle support rod 36 which has an end of a mounting rod 38 projecting from the cavity 32 end thereof is inserted one at a time in each of the mounting holes 16 of the support member, and then a wine bottle support rod 36 which does not have a mounting rod threaded into the cavity thereof is thread onto the end of each mounting rod 36 which projects beyond the opposite face of the support member 12 until both wine bottle support rods are pressed tightly against the respective faces of the support member. This process is repeated until each mounting hole has one end of a mounting rod 38, whose other one end is threaded into the support rod cavity of a support rod 36, projecting through it and onto which is tightly threaded another support rod 36, thereby producing a free standing wine rack 10*b* of this invention which has wine bottle support rods 36 projecting in a uniform pattern from both faces thereof.

Example 5

As another method of producing a free standing wine rack 10*b* of Example 4 with wine bottle support rods 36 projecting from both faces thereof, offsite cut half of the support rods needed to mount a wine bottle support rod 36 on each side of each mounting hole in support member 12 into 8½ inch rather than 8 inch lengths and instead of creating a female threaded cavity 32 in one end thereof, tap thread a half inch length of corresponding ⅜ inch male threads at one end thereof so it can be slip insertable into a ⅜ inch mounting hole 16 in support member 12 with a ⅜ inch threaded end portion thereof projecting ⅜ inch beyond the opposite face of the support member.

Onsite, after the support member 12 has been vertically positioned in its installed free standing position as described in Example 4, one-by-one insert the threaded end of one of the 8½ inch male threaded wine bottle support rods (not shown) through each of the mounting holes 16 in support member 12 and then from the opposite face of the support member thread the threaded cavity end of an 8 inch wine bottle support rod 36 onto the male threaded end of the 8½ inch support rod which projects through the mounting hole by twisting one of the rods while holding the other stationary until both support rods are pressed tightly against respective faces of the support member 12, thereby producing onsite a free standing wine rack otherwise corresponding to the wine rack 10*b* shown in FIG. 5.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

Parts List

10 Side Wall Wine Rack
10*a* Corner Wine Rack
10*b* Free Standing Wine Rack
12 SideWall Support Member
12*a* Corner Support Member
12*b* Free Standing Support Member
14 Wine Bottle
14*a* Smaller Side Wall Diameter Wine Bottle
14*b* Larger Side Wall Diameter Wine Bottle
16 Mounting Hole
18 Machine Bolt Threaded End
20 Machine Bolt
24 Machine Bolt Head
26 Wall Facing Face of Support Member
28 Exposed Face of Support Member
30 Tack Weld Spot
32 Support Rod Cavity
36 Wine Bottle Support Rod
38 Mounting Rod
40*a* First Wall of Room
40*b* Second Wall of Room
40*c* Ceiling of Room
40*d* Floor of Room
42 Shoulder of Corner Mounted Support Member
44 Installation screw
46 Corner of Room
48 Support Wire
50 Floor Positioning U-clamp

What is claimed is:

1. An open faced wine rack for storing horizontally thereon a plurality of wine bottles which have the same or substantially the same sidewall diameter, which wine rack has as its structural elements, (a) as the sole vertical support collectivey for wine bottles stored on the wine rack, a planar rigid monolithic quadrilateral vertical support member which has parallel first and second faces and has mounted against at least the first face thereof;

(b) as the sole horizontal support individually for wine bottles stored on the wine rack, a plurality of identical straight rigid round metal wine bottle support rods, a first end of each of which is threaded and has a face which is perpendicular to the longitudinal axis of the wine bottle support rods and each of which is cantilever-mounted at its first end on the support member equidistantly from and parallel to each other, flush and flat against the first face of the support member, in equidistantly positioned rows, each of which contain at least three of the support rods;

(c) as first mounting means for the support rods, a plurality of identical round holes in the support member whose diameter is less than that of the support rods and the center of each of which is coaxial with the longitudinal axis of one of the support rods over which each hole one of the support rods is mounted:

(d) as second mounting means for the support rods, a plurality of identical straight round metal solid mounting rods whose diameter is slightly less than the diameter of the round holes, whose length is at least the sum of its diameter plus the thickness of the support member, wherein one each thereof is slip fitted and positioned in one of the round holes with a first threaded end thereof projecting beyond the first face of the support member, wherein a second end of each thereof is rigidly connected to an enlarged member which (i) has a flat under face which is perpendicular to the longitudinal axis of the mounting rod; (ii) acts as a stop which prevents the second end of the mounting rods from entering the round hole; (iii) is pressed flush against the second face of the support member so tightly that the mounting rod cannot rotate within the hole in which it is positioned; and (iv) maintains the longitudinal axis of the mounting rod perpendicular to the first face of the support member; and wherein at least the portion of the first end of each of the mounting rods which projects beyond the first face of the support member is threaded cooperatively with respect to the threaded end portion of the metal rods and is tightly screwed connected thereto, whereby the enlarged member at the second end of the mounting rods and the threaded first end of the support rods cooperatively maintain the support rods firmly and immovably mounted against the first face of the support member, and wherein (i) the support rods are long enough and three of which when mounted on the support member side-by-side in the same row are strong enough when mounted on the support member to stably support two filled wine bottles having the same or substantially the same sidewall diameter;

(ii) each row of the support rods is uniformly spaced from adjacent rows thereof at a distance such that wine bottles of a size for which the wine rack is designed which have the narrowest sidewall diameter can be stored above those which have the widest sidewall diameter on adjacent rows of the support rods without their side walls touching;

(iii) the support rods in the same row are spaced uniformly from each other a distance such that wine bottles of a size for which the wine rack is designed which have the widest sidewall diameter can be stored side-by-side in the same row without their side walls touching; and (iv) the diameter of the support rods is large enough that a wine bottle of a size for which the wine rack is designed which has the narrowest sidewall diameter can be supported by two wine bottle support rods which are side-by-side in the same row.

2. A wine rack according to claim 1, wherein at least one of (a) the support rods and (b) the support member are solid stainless steel.

3. A wine rack according to claim 1, wherein the mounting rods are machine bolts and the enlarged member is the head of the machine bolt which is bonded to the second face of the support member and the threaded end thereof projects beyond the first face of the support member.

4. A wine rack according to claim 1, wherein the first end of each support rod which is firmly pressed against the first face of the support member has a female threaded cavity therein into which the first threaded end of a mounting rod which projects beyond the first face of the support member is threaded.

5. A wine rack according to claim 1, wherein each of the mounting rods extends beyond both faces of the support member, is threaded at both ends thereof and the enlarged member thereof is one of the support rods which has a female threaded cavity therein, into which the threaded end of the mounting rod which extends beyond the second face of the support member is threaded.

6. A wine rack according to claim 1 wherein the support member is at least about 3 feet wide and at least about 4 feet long and has a plurality of installation holes therein for installing the support member in a stable vertical position.

7. A wine rack according to claim 1, wherein the support member has mounting means in the face thereof adapted for mounting the wine rack on a wall of a room, which mounting means comprises a plurality of mounting holes proximate the top edge thereof which are adapted to receive a mounting nail, screw or bolt.

8. A wine rack according to claim 1, wherein the support member mounting means in the face thereof adapted for mounting the support member in a room in a vertical free standing position spaced apart from the walls of the room, either on a base on the floor of the room or hanging from the ceiling of the room and in contact with the floor thereof.

9. A wine rack according to claim 1, wherein (a) both the support rods and the support member are solid stainless steel; (b) the mounting rods are machine bolts whose threaded end projects beyond the first face of the support member and the enlarged member is the head of the machine bolt, which is bonded to the second face of the support member; (c) the first end of each support rod which is pressed against the first face of the support member has a female threaded cavity therein into which the threaded end of a machine bolt is threaded; (d) the support member is at least about 3 feet wide and at least about 4 feet long; and (e) the support member has mounting means in the face thereof adapted for mounting the wine rack against a wall of a room, which mounting means comprises a plurality of mounting holes proximate the top edge thereof which are adapted to receive a mounting nail, screw or bolt.

10. A wine rack according to claim 1, wherein both ends of the mounting rods extend beyond the faces of the support member, both ends are male threaded and the enlarged member thereof is a support rod which has a female threaded cavity therein, into which the end portion of the threaded end of the mounting rod which extends beyond the second face of the support member is threaded, and both faces of the wine rack thereby have the mounting rods projecting perpendicularly therefrom.

11. A wine rack according to claim 1, which has a first area on which a first group of the rods are positional thereon at a distance adapted to store a plurality of wine bottles thereon of a first smaller size thereon and which has a second area on which a second group of the rods are positioned thereon at a distance adapted to store a plurality of wine bottles thereon of a second larger size.

12. A combination of a plurality of wine rack according to claim 1 and a wall of a room onto which the wine racks are mounted edge to edge.

13. A combination of a plurality of wine racks according to claim 9 and a wall of a room onto which the wine racks are mounted edge to edge.

14. A: kit of fabricated structural elements which are adapted for onsite assembly thereof to form an open faced wine rack for storing horizontally thereon a plurality of wine bottles of the same or substantially the same sidewall diameters, which structural elements comprise:

(a) as the sole vertical support collectively for wine bottles stored on the assembled wine rack, a planar rigid monolithic quadrilateral vertical support member which has parallel first and second faces and a plurality of identical round mounting holes therein (b) as the sole horizontal support individually for wine bottles stored on the assembled wine rack, a plurality at least as great as the number of mounting holes in the support member of identical straight rigid round wine bottle support rods whose diameter is greater than that of the mounting holes in the support member and a first end of which is threaded; whose length is at least about the length of the sidewall of wine bottles for which the wine rack is adapted to store thereon and whose bending and breaking strengths are sufficient for three thereof which are mounted side-by-side in the same row on the support member will support two of the filled wine bottles;

(c) a plurality at least as large as the number of mounting holes in the support member of straight round solid metal or high strength plastic mounting rods whose diameter is slightly less than the diameter of the mounting holes in the support member, whose length is at least the sum of its diameter plus the thickness of the support member, each of which is or is adapted to be slip fit positioned in one of the round mounting holes, a first end of each of which is threaded and extends beyond the first face of the support member, a second end of each of which is or is adapted to be connected to an enlarged member which (i) has a flat under face; (ii) acts as a stop which prevents the second end of the mounting rod when fitted in one of the mounting holes in the support member from entering the hole; (iii) is fitted flush or is adapted to be fitted flush against the second face of the support member so tightly when the wine rack is assembled that the mounting rod cannot rotate within the hole in which it is positioned; and when thus fitted (iv) maintains the longitudinal axis of the mounting rod perpendicular to both faces of the support member; and wherein at least the portion of the second end of each of the mounting rods which projects beyond the first face of the support member is threaded cooperatively with resect to the threaded end portion of the support rods and is adapted to be threaded connected thereto, whereby the enlarged member of the mounting rod and the threaded second connection of the mounting rod cooperatively maintain, when the wine rack is assembled, the support rods firmly and immovably mounted against the first face of the support member, and wherein (i) the support rods are long enough and three thereof side-by-side in the same row or the assembled wine rack are strong enough when mounted on the support member to stably support two filled wine bottles having the same or substantially the same sidewall diameter;

(ii) each row of mounting holes in the support member is uniformly spaced from adjacent rows of mounting holes at a distance such that wine bottles of a size for which the wine rack is designed which have the widest sidewall diameter can be stored one above the other on adjacent rows of the assembled wine rack without their side walls touching;

(iii) each mounting hole in the support member is spaced uniformly from mounting holes on either side thereof in the same row at a distance such that wine bottles of a size for which the wine rack is designed which have widest sidewall diameter can be stored side-by-side in the same row of the assembled wine rack without their sidewalls touching; and (iv) the diameter of the support rods is large enough that a wine bottle of a size for which the wine rack is designed which has the narrowest sidewall diameter can be supported by two adjacent wine bottle support rods in the same row of the assembled wine rack.

15. A kit according to claim 14, wherein at least one of (a) the support rods and (b) the support member are solid stainless steel.

16. A kit according to claim 14, wherein the mounting rods are machine bolts and the enlarged member is the head of the machine bolt which is bonded to the second face of the support member.

17. A kit according to claim 14, wherein the first end of each of the support rods which is firmly pressed against the first face of the support member has a female threaded cavity therein into which the first threaded end of a mounting rod which projects beyond the first face of the support member is threaded.

18. A kit according to claim 14, wherein each of the mounting rods extends beyond both faces of the support member, is threaded at both ends thereof and the enlarged member thereof is one of the support rods which has a female threaded cavity therein, into which the threaded end of the mounting rod which extends beyond the second face of the support member is threaded.

19. A kit according to claim 14, wherein the support member is at least about 3 feet wide and at least about 4 feet long and has a plurality of installation holes therein for installing the support member in a stable vertical position.

20. A kit according to claim 14, wherein the support member has mounting means in the face thereof adapted for mounting the wine rack on a wall of a room, which mounting means comprises a plurality of mounting holes proximate the top edge thereof which are adapted to receive a mounting nail, screw or bolt.

21. A kit according to clam 14, wherein the support member has mounting means in the face thereof adapted for mounting the support member in a room in a vertical free standing position spaced apart from the walls of the room, either on a base on the floor of the room or hanging from the ceiling of the room and in contact with the floor thereof.

22. A kit according to claim 14, wherein (n) both the support rods and the support member are solid stainless steel; (b) the mounting rods are machine bolt, whose threaded end projects beyond the first face of the support member and the enlarged member is the head of the machine bolt which is bonded to the second face of the support member; (c) the first end of each of the support rods which is pressed against the first face of the support member has a female threaded cavity therein into which the first threaded end of a mounting rod is threaded; (d) the support member is at least about 3 feet wide and at least about 4 feet long; and (e) the support member has mounting means in the face thereof adapted for mounting the wine rack against a wall of a room, which mounting means comprises a plurality of mounting holes proximate the top edge thereof which are adapted to receive a nail, screw or bolt.

23. A combination of a plurality of wine racks according to claim 1 and a sidewall of a room onto which the wine racks are rigidly and stably mounted edge to edge vertically thereon against the interior face of the sidewall.

24. A combination of a plurality of wine racks according to claim 9 and a sidewall of a room onto which the wine racks are rigidly and stably mounted edge to edge vertically thereon against the interior face of the sidewall.

25. A method of producing onsite a wine rack of claim 1 which is adapted to be mounted on an interior face of a wall of a room or on the floor of a room, which comprises the offsite fabricating steps of:

(a) forming, in a planar rigid monolithic quadrilateral support member large enough and strong enough to be the vertical support member of the wine rack a plurality of at least three identical round mounting holes in each of a plurality of rows, each of which rows is spaced apart from adjacent rows thereof at a distance such that the sidewalls of bottles which are stored in one row of the fabricated wine rack do not touch the sidewalls of bottles stored in a row adjacent thereto and each mounting hole is spaced uniformly from other mounting holes in the same row at a distance such that a wine bottle stored on the assembled wine rack which has the narrowest width will be supported by two adjacent wine bottle support members; and (b) forming a female threaded cavity in one end of a plurality at least as great as the number of mounting holes in the support member, of identical straight rigid round metal or plastic rods suitable for use as support rods for wine bottles in the assembled wine rack, whose diameter is greater than that of the mounting holes in the support member and whose length is at least about the length of the sidewall of wine bottles for which the wine rack is adapted to store thereon; which comprises the subsequent steps, either onsite or off site, of (c) inserting in each mounting hole a straight round solid mounting rod which (i) is male threaded at least at a first end thereof so as to be threadably connectable to the female threaded end of one of the support rods, iii) has a diameter which is slightly less than the diameter of the mounting hole so that it can be slip fitted into and through one of the mounting holes, (iii) has a length which is at least the sum of twice its diameter plus the thickness of the support member so that a threaded end thereof projects beyond the first face of the support member, (iv) has rigidly connected to the second end thereof an enlarged member which is larger than the mounting hole, which has a flat under face which is perpendicular to the longitudinal axis of the mounting rod and which acts as a stop which prevents the second end of a mounting rod which is inserted in a mounting hole from entering the mounting link, so that the underface of the enlarged member is flush against the second face opposite support member;

(d) bonding to the vertical support member each mounting rod which is thus inserted in a mounting hole thereof which comprises the step of (e) transporting the thus fabricated support member and the thus fabricated plurality of rods to the installation site for the wine rack; and which comprises the subsequent onsite steps of:

(f) stably mounting the thus fabricated support member in at vertical configuration at the installation site, either against a wall of a room or free standing at a distance therefrom on the floor of the room; and (g) mounting the wine bottle support rods on the vertical support member by rigidly threading the fabricated end of each of the thus-fabricated support rods projecting from the exposed face of the vertical support member so that the threaded free end of each of the mounting rods is pressed tightly flush against the exposed face of the vertical support member and projects outwardly perpendicularly therefrom, parallel to the other thus mounted support rods; and, when the wine rack is installed free standing at a distance from the sidewalls of the room, (h) stabilizing the support member from swaying or pending.

26. A method according to claim 25 wherein the rods and the support member are formed of stainless steel; steps (c) and (d) and also a plurality of installation holes for installing the support member in a stable vertical position are formed in the support member are performed offsite; the mounting rod is a machine bolt whose shank is fitted through one of the holes in the support member with its threaded end projecting axially perpendicularly outwardly from the first face of the support member and whose head is bonded to the second face of the support member; and in step (f) the wine rack is installed in a vertical configuration against a wall of a room.

* * * * *

UNITED STATES PATENT AND TRADEMARK OFFICE

CERTIFICATE OF CORRECTION

PATENT NO. : 6,763,956 B2
DATED : July 20, 2004
INVENTOR(S) : Daniel Woods

It is certified that error appears in the above-identified patent and that said Letters Patent is hereby corrected as shown below:

Column 16,
Line 29, “support collectivey” should read -- support collectively --.

Column 17,
Line 58, “claim 1 wherein” should read -- claim 1, wherein --.

Column 18,
Line 2, “member mounting” should read -- member has mounting --.
Line 33, “rods are positional” should read -- rods are positioned --.

Column 19,
Line 18, “positioned; and” should read -- positioned; and, --.
Line 24, “with resect” should read -- with respect --.
Line 32, “same row or” should read -- same row of --.

Column 20,
Line 18, “clam 14,” should read -- claim 14, --.
Line 24, “wherein (n)” should read --wherein (a) --.
Line 26, “are machine bolt,” should read -- are machine bolts --.
Line 65, “support members; and” should read -- support members; --

Column 21,
Line 12, “rods, iii)” should read -- rods, (ii) --.
Line 25, “mounting link,” should read -- mounting hole, --.
Line 27, “second face opposite” should read -- second face of the --.
Line 29, “mounting hole thereof” should read -- mounting hole thereof; --.

Column 22,
Line 4, “at vertical” should read -- a vertical --.
Line 19, “pending.” should read -- bending. --.

UNITED STATES PATENT AND TRADEMARK OFFICE

CERTIFICATE OF CORRECTION

PATENT NO. : 6,763,956 B2
DATED : July 20, 2004
INVENTOR(S) : Daniel Woods

It is certified that error appears in the above-identified patent and that said Letters Patent is hereby corrected as shown below:

Column 22, (cont'd,)
Line 20, "claim 25 wherein" should read -- claim 25, wherein --.

Signed and Sealed this

Third Day of May, 2005

JON W. DUDAS
*Director of the United States Patent and Trademark Office*